US008783204B1

(12) United States Patent
Herold

(10) Patent No.: US 8,783,204 B1
(45) Date of Patent: Jul. 22, 2014

(54) COLLAPSIBLE KAYAK

(76) Inventor: John Herold, Downingtown, PA (US)

( * ) Notice: Subject to any disclaimer, the term of this patent is extended or adjusted under 35 U.S.C. 154(b) by 80 days.

(21) Appl. No.: 13/596,440

(22) Filed: Aug. 28, 2012

(51) Int. Cl.
*B63B 7/00* (2006.01)

(52) U.S. Cl.
USPC ..... 114/354; 114/352

(58) Field of Classification Search
CPC .... B63B 35/71; B63B 2035/715; B63B 3/00; B63B 7/04; B63B 3/08; B63B 2007/003; B63B 2007/006; B63B 7/06; B63B 7/02; B63B 29/04
USPC ..... 114/347, 352, 353, 354, 363
See application file for complete search history.

(56) References Cited

U.S. PATENT DOCUMENTS

| | | | | |
|---|---|---|---|---|
| 1,462,800 | A * | 7/1923 | Clemmer | 114/353 |
| 2,600,757 | A | 6/1952 | Grimston | |
| 2,659,464 | A * | 11/1953 | Sweetman | 114/353 |
| 3,816,865 | A * | 6/1974 | Ragan | 114/352 |
| 4,478,167 | A * | 10/1984 | Hart | 114/352 |
| 4,841,899 | A | 6/1989 | Fleckles et al. | |
| 5,353,733 | A | 10/1994 | Evans | |
| 6,263,827 | B1 | 7/2001 | Szigeti | |
| 6,615,762 | B1 | 9/2003 | Scott | |
| 2008/0121166 | A1 | 5/2008 | Yaron et al. | |
| 2009/0165695 | A1 | 7/2009 | Fritsch | |

OTHER PUBLICATIONS

Foldlite 10 ft. Folding Kayak—Boat-In-The-Bag. http://www.google.com/products/catalog?hl=en&q=Folding+Kayak&gs_upl=3552l3552l11368511111010101010101l010&bav=on.2,or.r_gc.r_pw.,cf.osb&biw=1440&bih=805&um=1&ie=UTF-8&tbm=shop&cid=14133729298579996023&sa=X&ei=p1TFTqKFKOXx0gHr8PGFDw&ved=0CHYQ8glwAA.

* cited by examiner

*Primary Examiner* — Lars A Olson
(74) *Attorney, Agent, or Firm* — Robert C. Montgomery; Montgomery Patent & Design

(57) ABSTRACT

A collapsible kayak comprises a bow unit, a central unit, and a stern unit. The bow unit and the stern unit are both connected to the central unit with hinges, allowing the collapsible kayak to assume either an "in use" orientation or a "storage" orientation. While the collapsible kayak is in the "in use" orientation, the bow unit, the central unit, and the stern unit are held into a linear shape with removable clamps. While the collapsible kayak is in the "storage" orientation, the bow unit and the stern unit are folded back and locked into place with a securing device.

17 Claims, 8 Drawing Sheets

COLLAPSIBLE KAYAK

RELATED APPLICATIONS

Not Applicable.

FIELD OF THE INVENTION

The presently disclosed subject matter is related to providing a watercraft that is collapsible, and more particularly, to a kayak having a stern section and a bow section removably attachable to a center section.

BACKGROUND OF THE INVENTION

Recreational boating has earned a well-deserved spot of the list of favorite pastimes of countless people. The ability to get outside and enjoy warm weather, sunshine, and water make all kinds of boating truly enjoyable. Many people turn to the use of a kayak to get out on the water, especially when fishing or just exploring local waterways and lakes when camping. Unfortunately, even small versions of such watercraft must be transported by trailer or on the roof of a large car or truck. Then problems also arise on where to store such boats when they are not in use. Their odd size takes up a large amount of space in garages and storage sheds. Others may be forced to store them outside in the yard, thus sacrificing aesthetic appeal of their home. Accordingly, there exists a need for a means by which kayaks can be modified to address the above mentioned deficiencies, yet remain a fun and easy to use watercraft.

There have been attempts in the past to provide watercraft to address the aforementioned deficiencies. U.S. Pat. App. Pub. No. 2008/0121166 in the name of Yaron et al. discloses a modular kayak. The parts of the Yaron et al. device interconnect with each other with a set of fasteners.

U.S. Pat. App. Pub. No. 2009/0165695 in the name of Fritsch discloses a collapsible kayak, comprising two (2) halves of a kayak body folded together and further incorporating an inflatable sponson.

U.S. Pat. No. 6,263,827 issued in the name of Szigeti discloses a folding kayak, comprising a water-tight hinge-mounting to enable the kayak to fold upward. The Szigeti kayak also requires inflatable sides and at least one (1) tensioning frame.

Unfortunately, none of the aforementioned attempts at providing such a collapsible kayak having a fore and aft boat portions hingedly attached to a center portion and further having fore and aft seals and seat portions foldingly affixed to the kayak as taught within the present invention.

SUMMARY OF THE INVENTION

The principles of the present invention provide for a collapsible kayak comprising a bow unit, a central unit pivotally attached to said bow unit, and a stern unit pivotally attached to said central unit.

Another aspect of the invention is to provide such a collapsible kayak having a storage orientation when each of said bow unit and said stern unit is folded over said central unit, and having an in use orientation when each of said bow unit and said stern unit is unfolded away from said central unit.

Another aspect of the invention is to provide such a bow unit trapezoidal in shape and comprising a vertically tapered bow front end, a bow rear end having a bow seal located along a perimeter of the bow rear end, a bow top surface, a bow bottom surface, a bow cavity located near said bow rear end and accessible from the bow top surface, a locking pin positioned on the bow top surface and located between the bow cavity and bow front end, and a plurality of bow apertures extending between the bow rear end and bow cavity.

Another aspect of the invention is to provide such a central unit hexagonal in shape and comprising a central front end having a central front seal extending along a perimeter of the central front end, a central rear end having a central rear seal extending along a perimeter of the central rear end, a central top surface, a central bottom surface, a central cavity accessible from the central top surface, a seat located in the central cavity, a plurality of front central apertures extending between the central cavity and central front end, and a plurality of rear central apertures extending between the central cavity and central rear end.

Another aspect of the invention is to provide such a stern unit trapezoidal in shape and comprising a stern front end having a stern seal located along a perimeter of the stern front end, a stern rear end, a stern top surface, a stern bottom surface, a stern top cavity located near the stern front end and accessible from the stern top surface, a stern bottom cavity open to the stern bottom surface and stern rear end so the stern bottom cavity receives the bow unit when the kayak is folded to the storage orientation, a slot positioned on the stern top surface near the stern front end, the slot receiving the locking pin therethrough when the stern unit is folded over the bow unit, and a plurality of stern apertures extending between the stern front end and stern top cavity.

Yet another aspect of the invention provides for the seats to further comprise a seat back and a seat base pivotally coupled to the seat back, wherein the seat back is folded down and positioned on top of the seat base while the collapsible kayak is folded to the storage orientation.

Yet still another aspect of the invention provides for a plurality of front clamps and a plurality of rear clamps. When the collapsible kayak is unfolded to the in use orientation, the front clamps are positioned through the bow apertures and front central apertures so the bow unit is secured to the central unit and when the collapsible kayak is unfolded to the in use orientation, the rear clamps are positioned through the stern apertures and rear central apertures so that the stern unit is secured to the central unit.

Yet still another aspect of the invention provides a locking pin to be inserted through the slot to thereby secure the stern unit to the bow unit when in the storage configuration.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
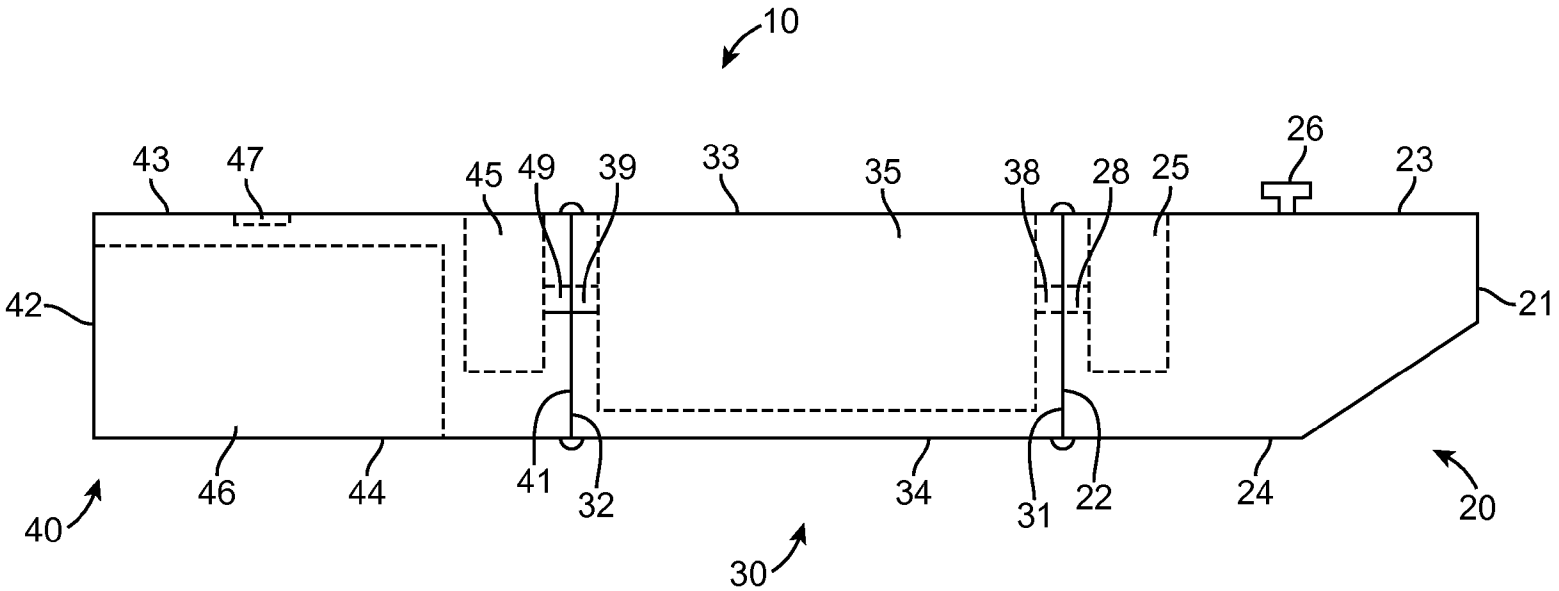
FIG. 1 is a side view of a collapsible kayak 10 while in an "in use" orientation.
Figure 2:
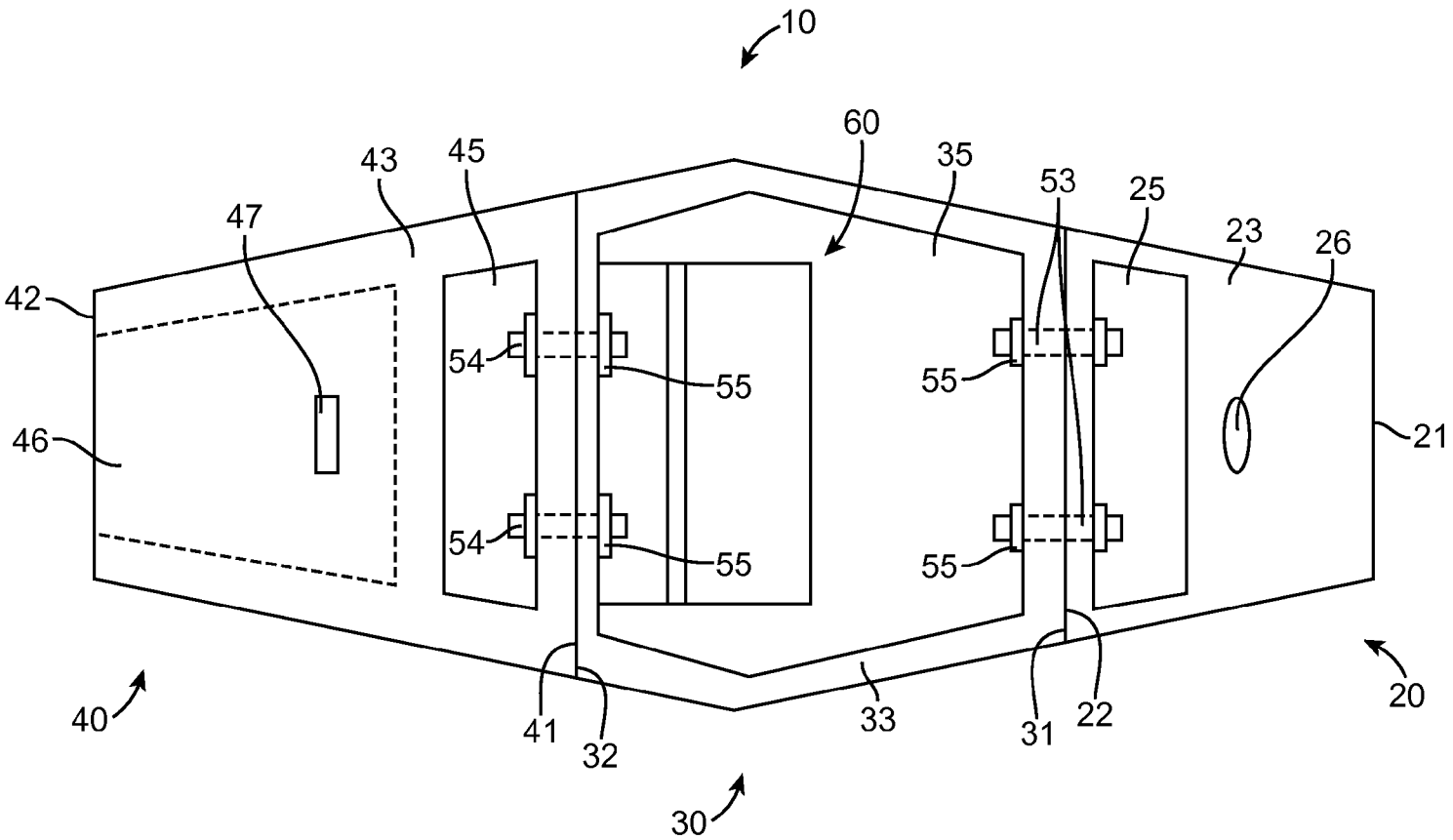
FIG. 2 is a top view of a collapsible kayak 10 while in an "in use" orientation.
Figure 3:
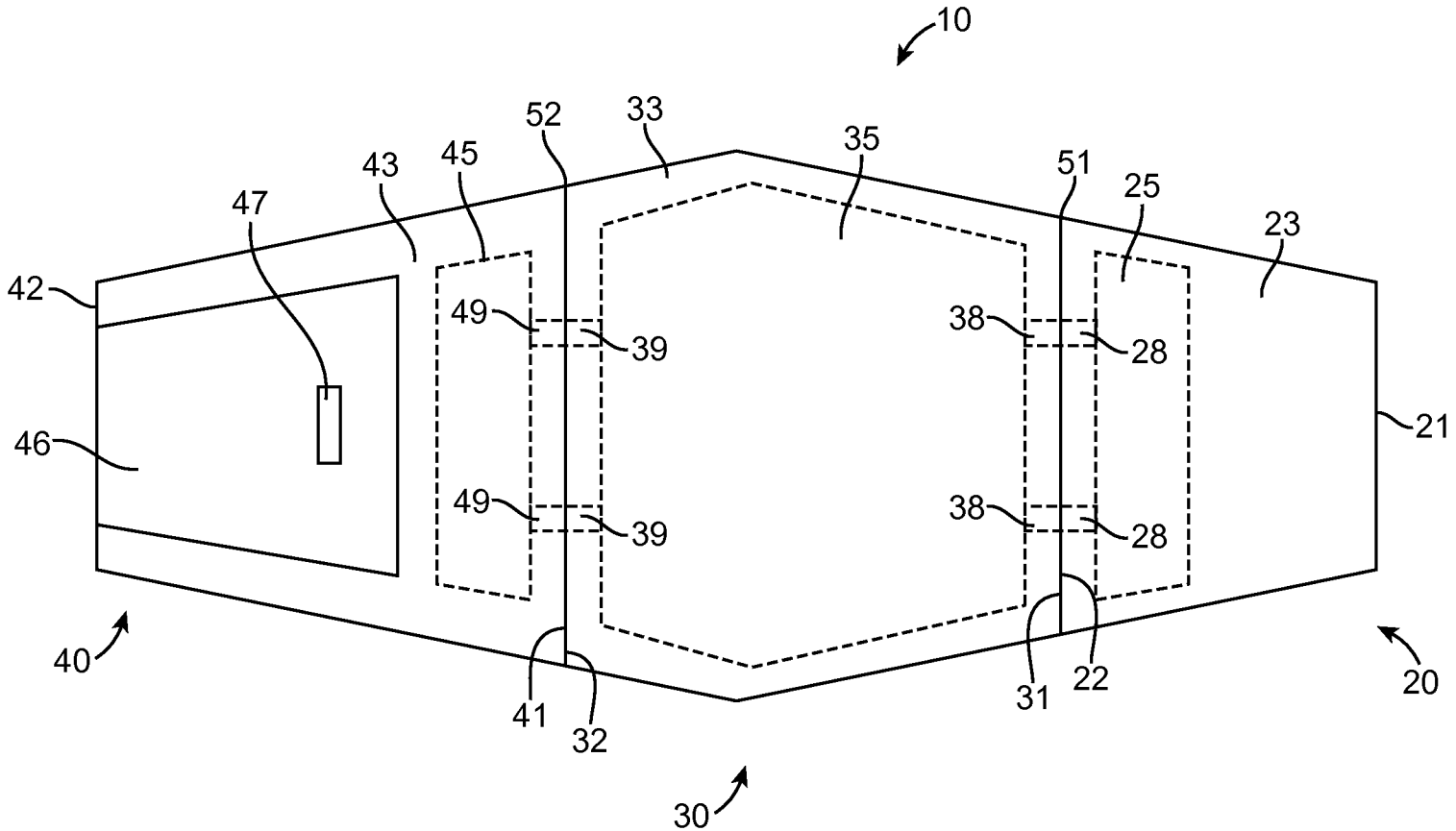
FIG. 3 is a bottom view of a collapsible kayak 10 while in an "in use" orientation.
Figure 4:
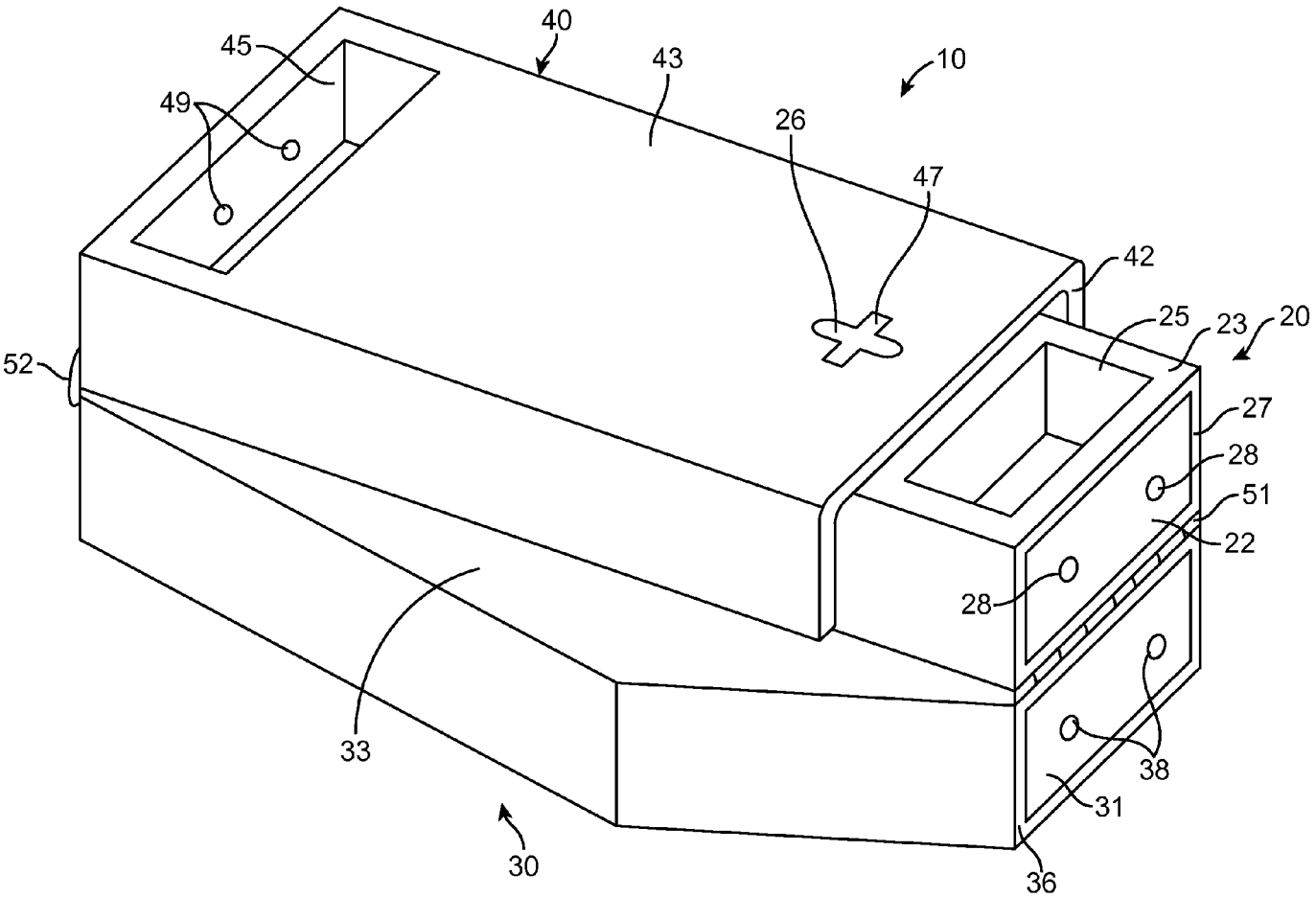
FIG. 4 is a perspective view of a collapsible kayak 10 while in a "storage" orientation.

| DESCRIPTIVE KEY | |
|---|---|
| 10 | collapsible kayak |
| 20 | bow unit |
| 21 | bow front end |
| 22 | bow rear end |
| 23 | bow top surface |
| 24 | bow bottom surface |
| 25 | bow cavity |
| 26 | locking pin |
| 27 | bow seal |
| 28 | bow aperture |
| 30 | central unit |
| 31 | central front end |
| 32 | central rear end |
| 33 | central top surface |
| 34 | central bottom surface |
| 35 | central cavity |
| 36 | central front seal |
| 37 | central rear seal |
| 38 | front central aperture |
| 39 | rear central aperture |
| 40 | stern unit |
| 41 | stern front end |
| 42 | stern rear end |
| 43 | stern top surface |
| 44 | stern bottom surface |
| 45 | stern top cavity |
| 46 | stern bottom cavity |
| 47 | slot |
| 48 | stern seal |
| 49 | stern aperture |
| 51 | front hinge |
| 52 | rear hinge |
| 53 | front clamp |
| 54 | rear clamp |
| 55 | wing nuts |
| 60 | seat |
| 61 | seat back |
| 62 | seat base |
| 63 | seat hinge |

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, depicting a collapsible kayak (herein described as an "apparatus") 10, where like reference numerals represent similar or like parts. The apparatus 10 comprises a bow unit 20, a central unit 30, and a stern unit 40. The bow unit 20, central unit 30, and stern unit 40 are all made of a sturdy and buoyant material, examples of which are plastic, fiberglass, or a synthetic fiber such as Kevlar. The apparatus 10 is designed in such a way to easily convert from an "in use" orientation to a "storage" orientation.

The bow unit 20 comprises a bow front end 21, a bow rear end 22, a bow top surface 23, a bow bottom surface 24, a bow cavity 25, and a locking pin 26. From a top perspective, the bow unit 20 is trapezoidal in shape. The bow front end 21 is vertically tapered. The bow rear end 22 features a bow seal 27 to prevent water from leaking into the apparatus 10. The bow seal 27 is made of a watertight material such as rubber and is located along the perimeter of the bow rear end 22 (see FIG. 6). The bow cavity 25 is located near the bow rear end 22 and is accessed from the bow top surface 23. A plurality of bow apertures 28 extends through the area that separates the bow rear end 22 from the bow cavity 25 and is used for securing the apparatus 10 while in an "in use" orientation. The locking pin 26 is used to secure the apparatus 10 when the apparatus is in a "storage" orientation. The locking pin 26 is positioned on the bow top surface 23 in between the bow cavity 25 and the bow front end 21 (see FIG. 8).

The central unit 30 comprises a central front end 31, a central rear end 32, a central top surface 33, a central bottom surface 34, and a central cavity 35. From a top perspective, the central unit 30 is hexagonal in shape. The central front end 31 and the central rear end 32 feature a central front seal 36 and a central rear seal 37 respectively. The central front seal 36 and the central rear seal 37 are made of a watertight material such as rubber to prevent water from leaking into the apparatus 10. The central front seal 36 is located along the central front end 31 and the central rear seal 37 is located along the perimeter of the central rear end 32 (see FIG. 6). The central cavity 35 is accessed from the central top surface 34 and is designed to comfortably seat a user of the apparatus. A seat 60 is provided in the central cavity 35 (see FIG. 5). A plurality of front central apertures 38 extends through the area that separates the central cavity 35 from the central front end 31. A plurality of rear central apertures 39 extends through the area that separates the central cavity 35 from the central rear end 32.

The stern unit 40 comprises a stern front end 41, a stern rear end 42, a stern top surface 43, a stern bottom surface 44, a stern top cavity 45, a stern bottom cavity 46, and a slot 47. From a top perspective, the stern unit 40 is trapezoidal in shape. The stern front end 41 features a stern seal 48 to prevent water from leaking into the apparatus 10. The stern seal 48 is made of a watertight material such as rubber and is located along the perimeter of the stern front end 41 (see FIG. 6). The stern rear end 42 and the stern bottom surface 44 provide access to the stern bottom cavity 46. The stern bottom cavity 46 is designed in a way to easily receive the bow unit 20 when the apparatus is in a "storage" orientation. The stern top cavity 45 is located near the stern front end 41 and is accessed from the stern top surface 43. A plurality of stern apertures 49 extends through the area that separates the stern front end 41 from the stern top cavity 45 and is used for securing the apparatus 10 while in an "in use" orientation. The slot 47 is used to secure the apparatus 10 when the apparatus is in a "storage" orientation and is positioned so as to receive the locking pin 26 when the apparatus 10 is in a "storage" orientation. The slot 47 is positioned on the stern top surface 43 near the stern front end 41.

The bow unit 20 is attached to the central unit 30 by a front hinge 51. The front hinge 51 is positioned on the bow bottom surface 24 near the bow rear end 22 and is also positioned on the central bottom surface 34 near the central front end 31.

When the apparatus 10 is in the "in use" orientation, the front hinge 51 positions the bow unit 20 and central unit 30 so that the bow rear end 22 is directly adjacent to the central front end 31. Also while in the "in use" orientation, the plurality of bow apertures 28 directly aligns and corresponds to the plurality of front central apertures 38. While in the "storage" orientation, the front hinge 51 allows the bow unit 20 to lay on top of the central unit 30 in a way that central bottom surface 34 is directly adjacent to the bow bottom surface 24.

The stern unit 40 is attached to the central unit 30 by a rear hinge 52. The rear hinge 52 is positioned on the stern bottom surface 44 near the stern front end 41 and is also positioned on the central bottom surface 34 near the central rear end 32. When the apparatus 10 is in the "in use" orientation, the rear hinge 52 positions the stern unit 40 and central unit 30 so that the stern front end 41 is directly adjacent to the central rear end 32. Also while in the "in use" orientation, the plurality of stern apertures 49 directly aligns and corresponds to the plurality of rear central apertures 39. While in the "storage" orientation, the rear hinge 52 allows the stern unit 40 to lay on top of the central unit 30 in a way that the central bottom surface 34 is directly adjacent to the stern bottom surface 44. Further, the stern bottom cavity 46 allows the stern unit 40 to lay on top of the bow unit 20 while the apparatus is in the "storage" orientation.

Figure 5:
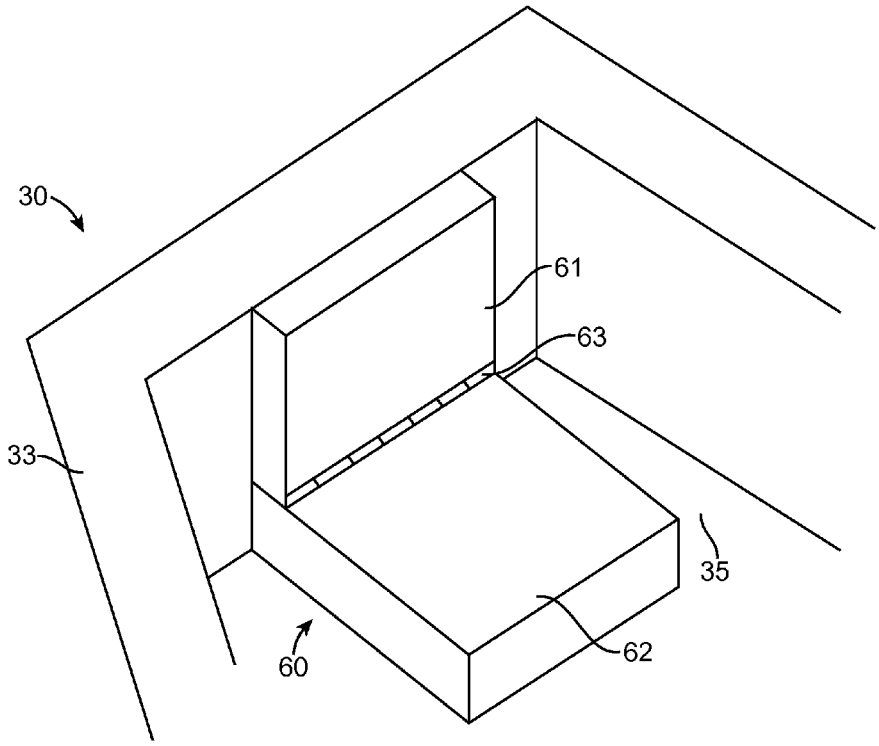
FIG. 5 is a close up view of a seat 60 of the collapsible kayak 10 while in an "in use" orientation.

Referring now to FIG. 5, a close up view of the seat 60 is provided. The seat 60 is positioned in the central cavity 35 and comprises a seat back 61, a seat base 62, and a seat hinge 63. The seat back 61 and the seat base 62 are made of a cushioned material and lined with a comfortable, waterproof material. The seat back 61 is connected to the seat base 62 by the seat hinge 63, allowing the seat back 61 to be folded down and on top of the seat base 62 while the apparatus 10 is in the "storage" orientation.

Figure 6:
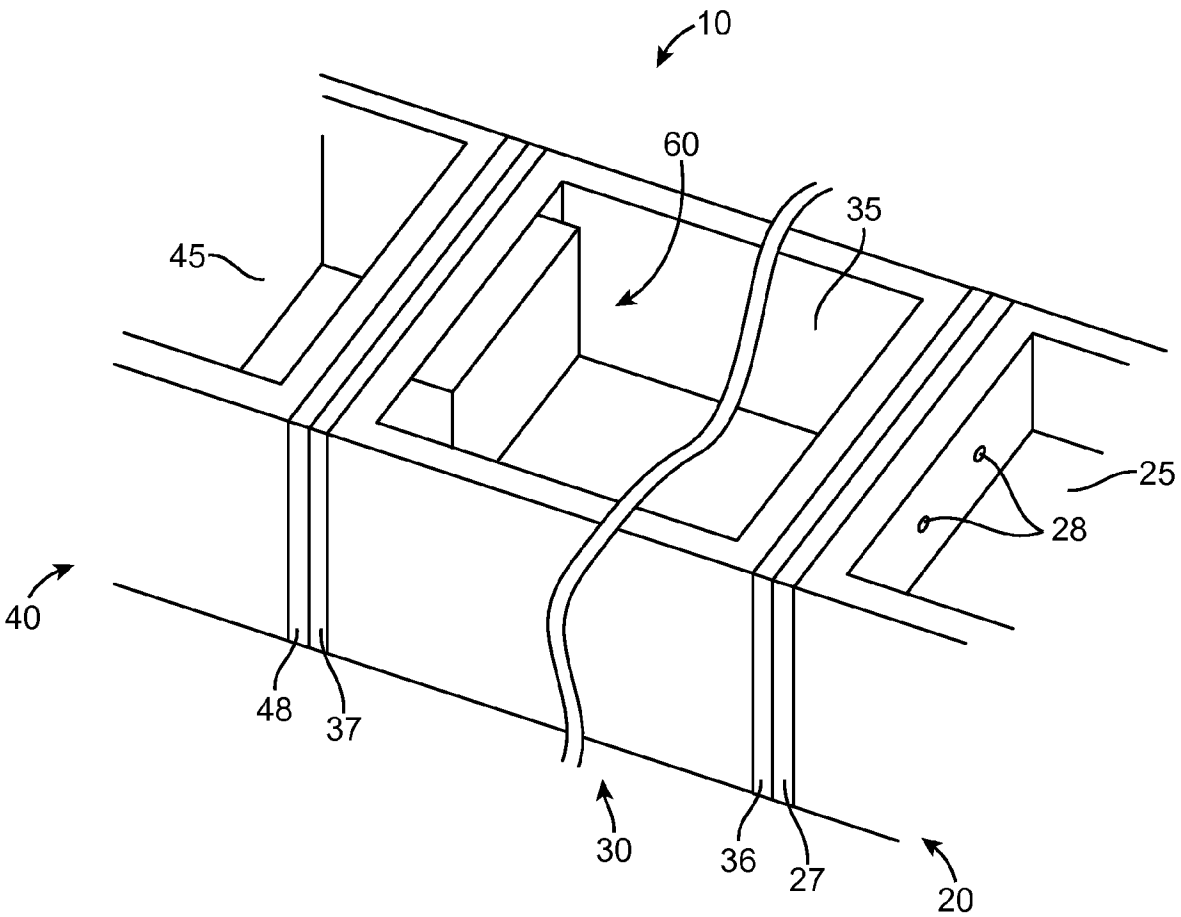
FIG. 6 is a close up view of a bow seal 27, a central front seal 36, a central rear seal 37, and a stern seal 48 of the collapsible kayak 10 while in an "in use" orientation.

Referring now to FIG. 6, a close up view of the bow seal 27, the central front seal 36, the central rear seal 37, and the stern seal 48 is provided. When the apparatus 10 is in an "in use" orientation, the bow seal 27 is in direct contact with the central front seal 36 and the stern seal 48 is in direct contact with the central rear seal 37. When the plurality of front clamps 53 and the plurality of rear clamps 54 (see FIG. 7) are tightly secured, the two (2) pairs of seals are secured tightly enough to prevent water from entering the apparatus 10 by means of any of the apertures.

Figure 7:
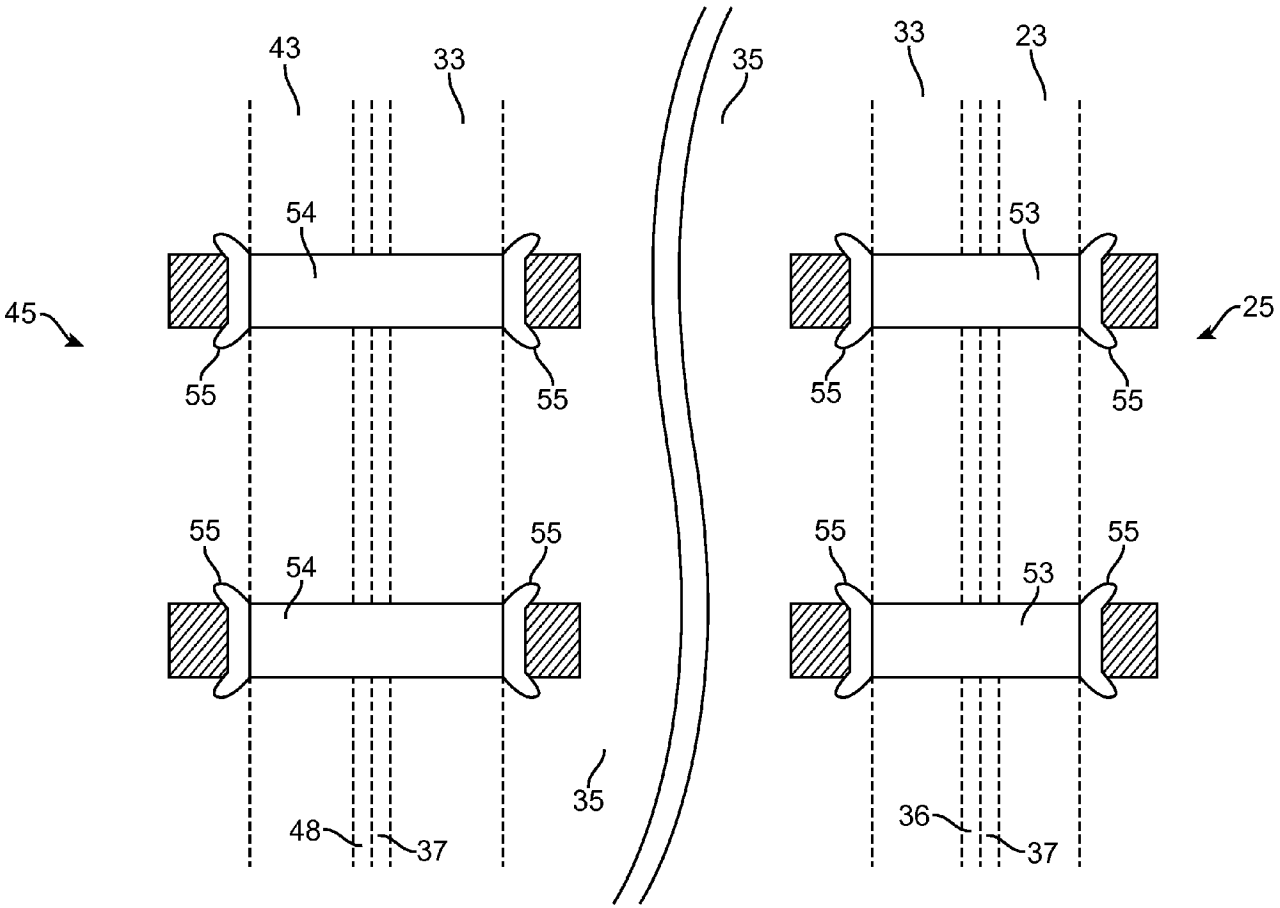
FIG. 7 is a close up view of a plurality of front clamps 53 and a plurality of rear clamps 54 of the collapsible kayak 10 while in an "in use" orientation; and, FIG. 8 is a close up view of a locking pin 26 of the collapsible kayak 10 while in a "storage" orientation.

Referring now to FIG. 7, a close up view of a plurality of front clamps 53 and a plurality of rear clamps 54 is provided. While the apparatus 10 is in the "in use" orientation, the bow unit 20 is secured to the central unit 30 by the plurality of front clamps 53. The front clamps 53 are inserted into the plurality of bow apertures 28 and through the plurality of front central apertures 38. The front clamps 53 are then secured with wing nuts 55. Similarly, the stern unit 40 is secured to the central unit 30 by the plurality of rear clamps 54. The rear clamps 54 are inserted into the plurality of stern apertures 49 and through the plurality of rear central apertures 39. The rear clamps 54 are also secured with wing nuts 55.

Figure 8:
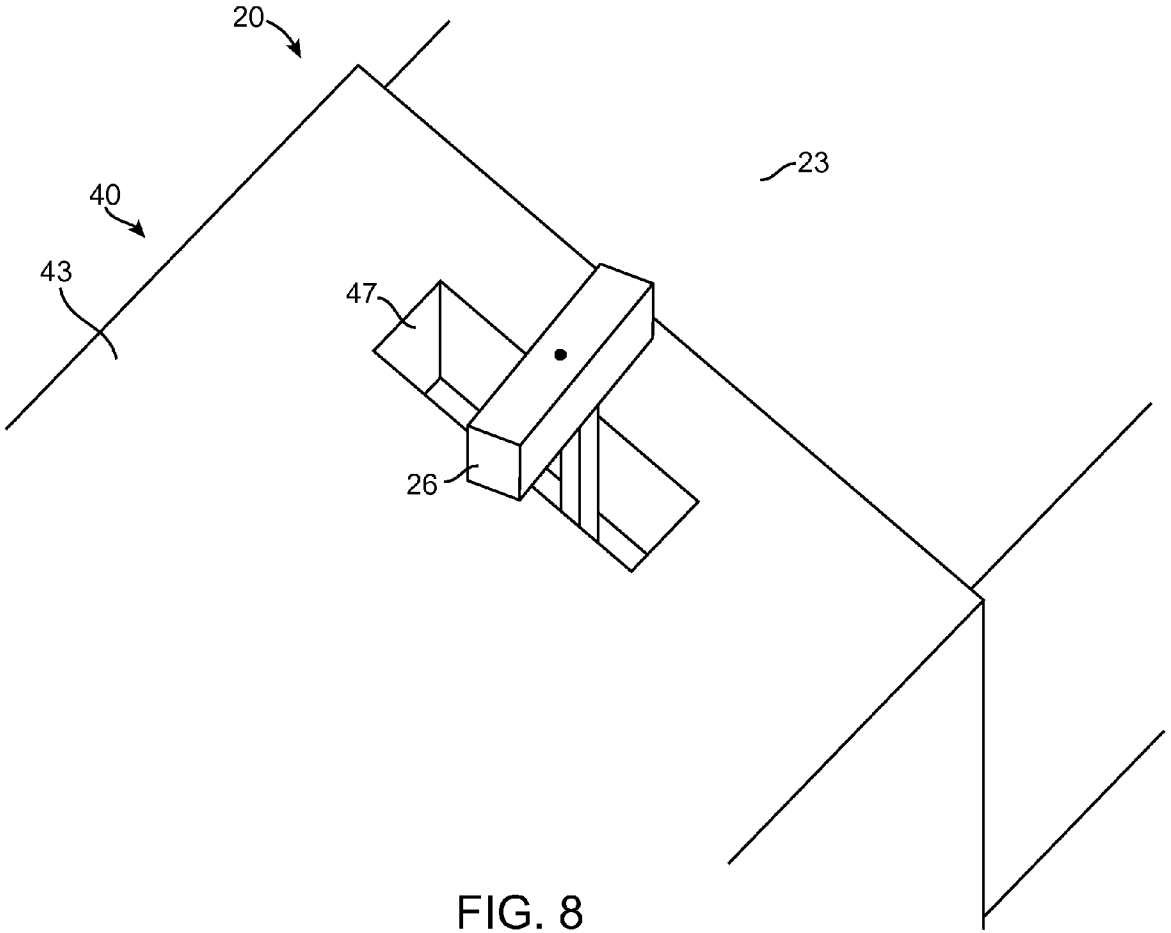

Referring now to FIG. 8, a close up view of the locking pin 26 and the slot 47 is provided. While the apparatus 10 is in the "storage" orientation, the apparatus 10 is locked into place by the locking pin 26 and the slot 47. As the stern unit 40 is folded into the "storage orientation," the locking pin 26 is inserted through the slot 47. The locking pin 26 is then turned perpendicular to the slot 47 in order to secure the apparatus 10.

The method of utilizing the apparatus 10 can be achieved by performing the following steps: bringing the apparatus 10 in the "storage" orientation to an appropriate body of water for kayaking; setting the apparatus onto dry land so that the locking pin 26 is facing upward; turning the locking pin 26 so that it is parallel to the slot 47; lifting the stern unit 40 and setting it on the ground; lifting the bow unit 20 and setting it on the ground; turning the apparatus 10 over; inserting the front clamps 53 through the plurality of bow apertures 28 and the plurality of front central apertures 38; securing the front clamps 53 with the wing nuts 55; inserting the rear clamps 54 through the plurality of stern apertures 49 and the plurality of rear central apertures 39; securing the rear clamps 54 with the wing nuts 55; folding up the seat back 61; enjoying a fully functional kayak.

After finishing kayaking, the method of utilizing the apparatus 10 can be further achieved by returning the kayak to dry land; folding down the seat back 60; removing the wing nuts 55 from the rear clamps 54; removing the rear clamps 54; removing the wing nuts 55 from the front clamps 53; removing the front clamps 53; turning the apparatus 10 over; lifting the bow unit 20 and setting it on the central unit 30; lifting the stern unit 40 and setting it on the bow unit 20 and the central unit 30; turning the locking pin 26 so that it is perpendicular to the slot 47; and then safely and securely transporting the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A collapsible kayak comprising:

a bow unit generally trapezoidal in shape and further comprising:

a vertically tapered bow front end;

a bow rear end having a bow seal located along a perimeter thereof;

a bow top surface;

a bow bottom surface;

a bow cavity located near said bow rear end and accessed from said bow top surface;

a locking pin positioned on said bow top surface such that said locking pin is located between said bow cavity and said bow front end; and, a plurality of bow apertures extending between said bow rear end and said bow cavity;

a central unit pivotally attached to said bow unit; and, a stern unit pivotally attached to said central unit;

wherein said collapsible kayak is at a storage orientation when each of said bow unit and said stern unit is folded over said central unit; and, wherein said collapsible kayak is at an in use orientation when each of said bow unit and said stern unit is unfolded away from said central unit.

2. The collapsible kayak of claim 1, wherein said central unit has a hexagonal shape and comprises:

a central front end having a central front seal extending along a perimeter of said central front end;

a central rear end having a central rear seal extending along a perimeter of said central rear end;

a central top surface;

a central bottom surface;

a central cavity accessed from said central top surface;

a seat located in said central cavity;

a plurality of front central apertures extending between said central cavity and said central front end; and, a plurality of rear central apertures extending between said central cavity and said central rear end.

3. The collapsible kayak of claim 2, wherein said stern unit has a trapezoidal shape and comprises:

a stern front end having a stern seal located along a perimeter of said stern front end;

a stern rear end;

a stern top surface;

a stern bottom surface;

a stern top cavity located near said stern front end and accessed from said stern top surface;

a stern bottom cavity open to said stern bottom surface and stern rear end such that said stern bottom cavity receives said bow unit when said collapsible kayak is folded to said storage orientation;

a slot positioned on said stern top surface near said stern front end, said slot receiving said locking pin therethrough when said stern unit is folded over said bow unit; and, a plurality of stern apertures extending between said stern front end and said stern top cavity.

4. The collapsible kayak of claim 3, wherein, when said collapsible kayak is unfolded to said in use orientation, said bow rear end is located directly adjacent to said central front end;

wherein, when said collapsible kayak is unfolded to said in use orientation, said bow apertures are directly aligned and correspond with said front central apertures; and, wherein, when said collapsible kayak is folded to said storage orientation, said bow unit lays on top of said central unit such that said central bottom surface is located directly adjacent to said bow bottom surface.

5. The collapsible kayak of claim 3, wherein, when said collapsible kayak is unfolded to said in use orientation, said stern front end is located directly adjacent to said central rear end;

wherein, when said collapsible kayak is unfolded to said in use orientation, said stern apertures are directly aligned and correspond with said rear central apertures;

wherein, when said collapsible kayak is unfolded to said in use orientation, said stern unit lays on top of said central unit such that said central bottom surface is located directly adjacent to said stern bottom surface; and, wherein, when said collapsible kayak is folded to said storage orientation, said stern bottom cavity receives said bow unit therein.

6. The collapsible kayak of claim 1, wherein seat comprises:

a seat back; and, a seat base pivotally coupled to said seat back;

wherein said seat back is folded down and positioned on top of said seat base while said collapsible kayak is folded to said storage orientation.

7. The collapsible kayak of claim 3, further comprising:

a plurality of front clamps; and, a plurality of rear clamps;

wherein, when said collapsible kayak is unfolded to said in use orientation, said bow seal is in direct contact with said central front seal and said stern seal is in direct contact with said central rear seal;

wherein, when said collapsible kayak is unfolded to said in use orientation, said front clamps are positioned through said bow apertures and said front central apertures such that said bow unit is secured to said central unit; and, wherein, when said collapsible kayak is unfolded to said in use orientation, said rear clamps are positioned through said stern apertures and said rear central apertures such that said stern unit is secured to said central unit.

8. The collapsible kayak of claim 3, wherein, when said collapsible kayak is folded to said storage orientation, said locking pin is inserted through said slot and thereby secures said stern unit to said bow unit.

9. A collapsible kayak comprising:

a bow unit generally trapezoidal in shape and further comprising:

a vertically tapered bow front end;

a bow rear end having a bow seal located along a perimeter thereof;

a bow top surface;

a bow bottom surface;

a bow cavity located near said bow rear end and accessed from said bow top surface;

a locking pin positioned on said bow top surface such that said locking pin is located between said bow cavity and said bow front end; and, a plurality of bow apertures extending between said bow rear end and said bow cavity;

a central unit pivotally attached to said bow unit; and, a stern unit pivotally attached to said central unit;

wherein said collapsible kayak is at a storage orientation when each of said bow unit and said stern unit is folded over said central unit;

wherein said collapsible kayak is at an in use orientation when each of said bow unit and said stern unit is unfolded away from said central unit; and, wherein said stern unit lays over said bow unit when said collapsible kayak is at a storage orientation.

10. The collapsible kayak of claim 9, wherein said central unit has a hexagonal shape and comprises:

a central front end having a central front seal extending along a perimeter of said central front end;

a central rear end having a central rear seal extending along a perimeter of said central rear end;

a central top surface;

a central bottom surface;

a central cavity accessed from said central top surface;

a seat located in said central cavity;

a plurality of front central apertures extending between said central cavity and said central front end; and, a plurality of rear central apertures extending between said central cavity and said central rear end.

11. The collapsible kayak of claim 10, wherein said stern unit has a trapezoidal shape and comprises:

a stern front end having a stern seal located along a perimeter of said stern front end;

a stern rear end;

a stern top surface;

a stern bottom surface;

a stern top cavity located near said stern front end and accessed from said stern top surface;

a stern bottom cavity open to said stern bottom surface and stern rear end such that said stern bottom cavity receives said bow unit when said collapsible kayak is folded to said storage orientation;

a slot positioned on said stern top surface near said stern front end, said slot receiving said locking pin therethrough when said stern unit is folded over said bow unit; and, a plurality of stern apertures extending between said stern front end and said stern top cavity.

12. The collapsible kayak of claim 11, wherein, when said collapsible kayak is unfolded to said in use orientation, said bow rear end is located directly adjacent to said central front end;

wherein, when said collapsible kayak is unfolded to said in use orientation, said bow apertures are directly aligned and correspond with said front central apertures; and, wherein, when said collapsible kayak is folded to said storage orientation, said bow unit lays on top of said central unit such that said central bottom surface is located directly adjacent to said bow bottom surface.

13. The collapsible kayak of claim 11, wherein, when said collapsible kayak is unfolded to said in use orientation, said stern front end is located directly adjacent to said central rear end;

wherein, when said collapsible kayak is unfolded to said in use orientation, said stern apertures are directly aligned and correspond with said rear central apertures;

wherein, when said collapsible kayak is unfolded to said in use orientation, said stern unit lays on top of said central unit such that said central bottom surface is located directly adjacent to said stern bottom surface; and, wherein, when said collapsible kayak is folded to said storage orientation, said stern bottom cavity receives said bow unit therein.

14. The collapsible kayak of claim 9, wherein seat comprises:

a seat back; and, a seat base pivotally coupled to said seat back;

wherein said seat back is folded down and positioned on top of said seat base while said collapsible kayak is folded to said storage orientation.

15. The collapsible kayak of claim 11, further comprising:

a plurality of front clamps; and, a plurality of rear clamps;

wherein, when said collapsible kayak is unfolded to said in use orientation, said bow seal is in direct contact with said central front seal and said stern seal is in direct contact with said central rear seal;

wherein, when said collapsible kayak is unfolded to said in use orientation, said front clamps are positioned through said bow apertures and said front central apertures such that said bow unit is secured to said central unit; and, wherein, when said collapsible kayak is unfolded to said in use orientation, said rear clamps are positioned through said stern apertures and said rear central apertures such that said stern unit is secured to said central unit.

16. The collapsible kayak of claim 11, wherein, when said collapsible kayak is folded to said storage orientation, said locking pin is inserted through said slot and thereby secures said stern unit to said bow unit.

17. A method of utilizing a collapsible kayak, said method comprising the steps of:

providing a bow unit generally trapezoidal in shape and further comprising:

a vertically tapered bow front end;

a bow rear end having a bow seal located along a perimeter thereof;

a bow top surface;

a bow bottom surface;

a bow cavity located near said bow rear end and accessed from said bow top surface;

a locking pin positioned on said bow top surface such that said locking pin is located between said bow cavity and said bow front end; and, a plurality of bow apertures extending between said bow rear end and said bow cavity;

providing and pivotally attaching a central unit to said bow unit;

providing and pivotally attaching a stern unit to said central unit;

configuring said collapsible kayak to an in use orientation by unfolding each of said bow unit and said stern unit away from said central unit; and, configuring said collapsible kayak to a storage orientation by folding each of said bow unit and said stern unit over said central unit such that said stern unit lays over said bow unit when said collapsible kayak is at a storage orientation.

* * * * *